US005222276A

United States Patent [19]

Glenn, III

[11] Patent Number: 5,222,276

[45] Date of Patent: Jun. 29, 1993

[54] VACUUM CLEANER FOR ON FLOOR AND OFF FLOOR SUCTION CLEANING

[75] Inventor: William K. Glenn, III, Anderson, S.C.

[73] Assignee: Ryobi Motor Products Corp., Easley, S.C.

[21] Appl. No.: 819,394

[22] Filed: Jan. 10, 1992

[51] Int. Cl.[5] ..... A47L 5/00

[52] U.S. Cl. ..... 15/333; 15/334; 15/337

[58] Field of Search ..... 15/333, 334, 354, 361, 15/337

[56] References Cited

U.S. PATENT DOCUMENTS

| | | | |
|---|---|---|---|
| 2,070,689 | 2/1937 | Smellie | 15/333 X |
| 2,202,982 | 6/1940 | Bell . | |
| 2,259,386 | 10/1941 | Luse . | |
| 2,300,204 | 10/1942 | Carlson | 15/333 |
| 2,325,821 | 8/1943 | White . | |
| 2,333,494 | 11/1943 | Snyder . | |
| 2,372,033 | 3/1945 | Taylor . | |
| 2,606,337 | 8/1952 | Balluff . | |
| 2,644,976 | 7/1953 | Osborn . | |
| 2,686,331 | 8/1954 | Humphrey | 15/333 |
| 2,719,319 | 10/1955 | Brace . | |
| 2,724,140 | 11/1955 | Daiger et al. . | |
| 3,579,699 | 5/1971 | Balzer | 15/361 |
| 3,955,237 | 5/1976 | Chateauneuf et al. | 15/323 |
| 4,171,554 | 10/1979 | Tschudy . | |
| 4,376,322 | 3/1983 | Lockhart et al. | 15/334 X |
| 4,573,236 | 3/1986 | Dyson | 15/334 X |
| 4,686,736 | 8/1987 | Petralia et al. . | |
| 4,811,452 | 3/1989 | Sumerau . | |
| 5,134,750 | 8/1992 | King et al. . | |

*Primary Examiner*—Stephen F. Gerrity
*Attorney, Agent, or Firm*—Brooks & Kushman

[57] ABSTRACT

An upright vacuum cleaner having an off-the-floor suction hose attachment port located in the passageway connected to the agitator chamber or front nozzle with a suction generating means, and having a sliding door for closing off the passageway intermediate the chamber and hose attachment port during off-the-floor operation, which door is automatically returned to its initial position opening the passageway when the operating handle position is altered to allow on-the-floor operation. The agitator or roller brush is lifted completely from contact with the floor or carpet when the vacuum cleaning apparatus is used for off-the-floor operation and is done so independently of the floor height adjustment setting for various on-the-floor cleaning operations by rotating the retainer axle member about the axis of the front casters and relative to the chassis. The retainer axle member further includes a chassis height adjusting support surface, and the cleaner hood includes a chassis height adjustment member carried and supported thereby for manual operator-assisted sliding engagement with the hood and with the retainer axle member. The height adjustment member includes a pair of laterally spaced cam surfaces and each cam surface includes identical step cams of varying height, thereby defining a plurality of pairs of matched height adjusting cam lobes laterally offset from one another. Each of the cam lobes engages the support surface of the axle retainer member whereby the chassis is supported laterally at two positions on the axle retainer member and provides side-to-side stability to the cleaner head assembly.

12 Claims, 6 Drawing Sheets

VACUUM CLEANER FOR ON FLOOR AND OFF FLOOR SUCTION CLEANING

TECHNICAL FIELD

This invention relates to vacuum cleaners, particularly those adapted for household and light industrial use and being of the upright type.

BACKGROUND ART

Upright vacuum cleaners are a particularly popular type of vacuum cleaner for household and light industrial vacuum cleaning of floors and floor carpeting. Typically, the unit includes a cleaner head assembly mounted on wheels and having a suction generator/motor assembly and a motor driven roller agitator or roller brush mounted on the chassis. The operating handle is pivoted to the chassis and can be placed in a lower inclined position to assist the operator in moving the vacuum cleaner over the carpet, and an upright position whereby the vacuum cleaner can be conveniently stored in a closet or the like and occupying minimal space. A filter bag is generally mounted on the handle within a hard case or a flexible fabric bag with the filter bag communicating with a suction passage within the chassis to collect the dirt-ladened air brought up from the floor or carpet. The handle may also carry a storage rack, e.g. for the electric cord providing power to the cleaner, and for other accessories.

Commonly, the cleaner head assembly includes an adjustment knob, or foot-actuated lever, for adjusting the height of the chassis, and thus the roller brush or agitator, relative to the floor.

Some upright vacuum cleaners also include a structural arrangement whereby the on-the-floor vacuum cleaning operation can be interrupted to provide for suction cleaning off-the-floor, such as cleaning venetian blinds or kick moldings about the floor, or chairs and other items of furniture and the like. An attachment hose is provided having an inlet which may be connected to the suction source or passageway communicating with the suction generating device. It is known, for example, to provide a separate attachment device over the front of the vacuum cleaner in the area of the agitator with the suction hose leading off of the device, as shown in U.S. Pat. No. 3,955,237. Storage of the device can be troublesome to the user, and the system necessitates passing the dirt-laden air over the agitator or roller brush, thus disturbing the efficiency of the system.

It is also known to provide means for blocking the air passageway between the agitator and the suction generating device and placing downstream of the blockage an auxiliary inlet port for attaching a suction-type attachment hose. Such systems require manually adjusting the blockage, e.g. a sliding door, from the open position to the closed position, and then manually opening the door when the vacuum cleaner is to be converted to on-the-floor use.

Further, with such known systems, it is necessary to disturb the floor height setting by manually adjusting the chassis height relative to the floor or asix of the rollers upon which it is moved across the floor to a position of maximum height and then beyond to fully lift the agitator free of any carpeting or floor. Thus, when the vacuum cleaner is returned to on-the-floor use, the floor height adjustment must again be manually adjusted to the preferred setting.

With known height adjusting structures, it is also common that the mechanism include a single cam on the chassis and cam follower located on an axial retainer member carrying the forwardmost rollers of the cleaner head assembly. Thus, with the chassis supported by two laterally spaced rollers or casters at the rear, i.e. one at each end of a rear axle member, and with the forward end of the chassis supported only at a single point upon which the height adjusting cam member rests on the cam follower, the cleaner head assembly is likely to feel to the operator slightly unsteady as it is permitted to rock about a swing axis extending longitudinally of the vacuum cleaner from front to rear and passing through the single support point defined by the height adjusting member.

SUMMARY OF THE INVENTION

The present invention contemplates an upright vacuum cleaner having an alternative off-the-floor suction cleaning apparatus easier to use by the operator and contemplating less manual adjustments than heretofore known.

The present invention further contemplates a vacuum cleaner of the type previously mentioned whereby the on-the-floor suction chamber is taken out of service when the vacuum cleaner is used for off-the-floor suction cleaning operation, and is automatically returned to service when the operator begins use of the vacuum cleaner as an on-the-floor suction cleaning apparatus.

The invention further contemplates a vacuum cleaner of the aforementioned type wherein the agitator or roller brush is lifted completely from contact with the floor or carpet when the vacuum cleaning apparatus is used for off-the-floor operation and is done so independently of the floor height adjustment setting for various on-the-floor cleaning operations.

The invention further contemplates a floor height adjustment mechanism cooperating with the axle retainer member carrying the forwardmost chassis rollers or casters, and being supported at two laterally spaced support points on the axle retainer member to thereby provide increased side-to-side stability to the cleaner head assembly.

Further, the invention contemplates an upright vacuum cleaner having an off-the-floor suction hose attachment port located in the passageway connected to the agitator chamber or front nozzle with a suction generating means, and having a door means for closing off the passageway intermediate the chamber and hose attachment port during off-the-floor operation, and the door means automatically opening the passageway when the operating handle position is altered to allow on-the-floor operation.

The invention further contemplates an on-the-floor suction cleaner as described immediately above and further including the chassis being supported for rolling contact with the floor by one roller means at the rear of the chassis and a second roller means intermediate the suction generating means and the agitator. The second rolling means being journalled to a retainer axle member pivotally connected to the chassis at a first pivot point and including a chassis lifting cam member for rotating the retainer axle member about the axis of the second rolling means from a lowered position to a lift position. The cam actuating means is secured on the handle for engaging the agitator lifting cam member when the operator handle is placed in an upright position and thereby causing the chassis to be lifted about the first pivot point to raise the agitator off the floor, and to return the agitator to contact with the floor when the handle is lowered from the upright position. The retainer axle member including means for retaining the door means in a position closing off the passageway when in the lift position and releasing the door means when adjusted to the lowered position.

The invention also contemplates the suction cleaning apparatus described immediately above whereby the retainer axle member further includes a chassis height adjusting support surface and wherein the cleaner hood includes a chassis height adjustment member carried by the hood and supported thereby for manual operator-assisted sliding engagement with the hood and with the retainer axle member. The height adjustment member includes a pair of laterally spaced cam surfaces and each cam surface includes identical step cams of varying height, thereby defining a plurality of pairs of matched height adjusting cam lobes laterally offset from one another. Each of the cam lobes engages the support surface of the axle retainer member whereby the chassis is supported laterally at two positions on the axle retainer member and provides side-to-side stability to the cleaner head assembly.

The above objects, features, and advantages of the present invention, as well as others not specifically mentioned, are readily apparent from the following detailed description of the best mode for carrying out the invention when taken in connection with the accompanying drawings.

BEST MODE FOR CARRYING OUT THE INVENTION

Figures 1, 2:
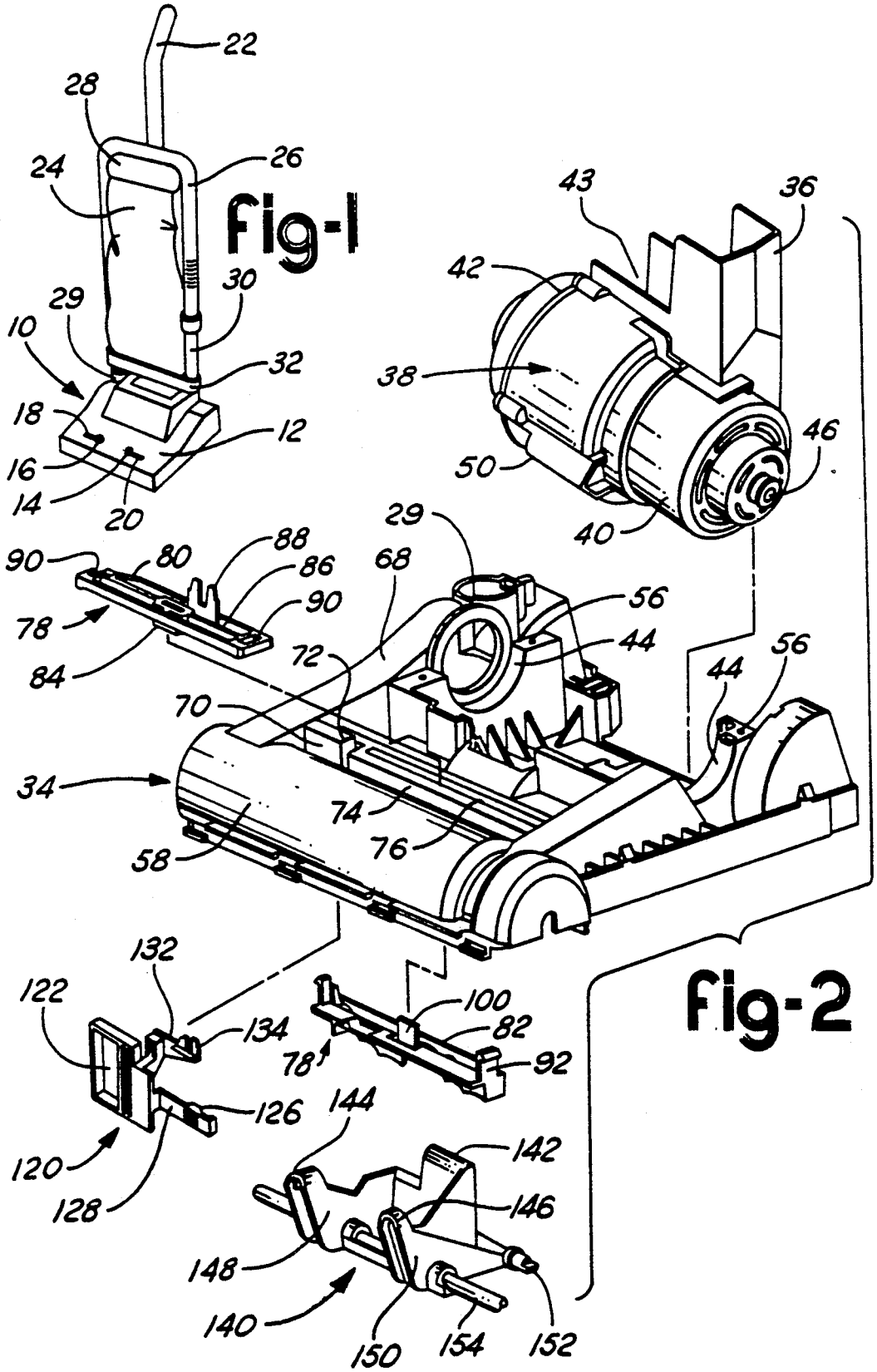
FIG. 1 is an overall perspective view of the vacuum cleaner assembly in accordance with the present invention.
FIG. 2 is an exploded perspective view of the cleaner head assembly, less the cleaner hood and supporting rollers or casters, and agitator, in accordance with the present invention.

As seen in FIG. 1, the upright-type vacuum cleaner of the present invention includes a vacuum cleaner head assembly, generally designated 10 covered by a hood 12. The hood carries two adjusting levers or knobs 14 and 16, within respective slotted openings 18,20 with the one knob 14 being manually adjustable for adjusting the height of the agitator or roller brush from the floor and the other knob 16 being manually adjustable to close off the suction passage to the agitator or roller brush when the vacuum cleaner assembly is to be used for off-the-floor suction operation, all of which is described below in detail.

The vacuum cleaner includes an operator handle 22 pivoted to the cleaner head assembly in a conventional manner, and carrying a filter bag assembly 24 and an off-the-floor suction attachment hose 26. The attachment hose is supported on a rest 28 and is secured to the cleaner head assembly at an attachment hose port 29 and adapted to be held and maneuvered by the operator at a nozzle inlet end 30 comprising a plastic cylindrical tube of conventional structure which is slidingly fitted or received within a recess within a lower receiver bar 32 which is also affixed to the operator handle.

Figure 3:
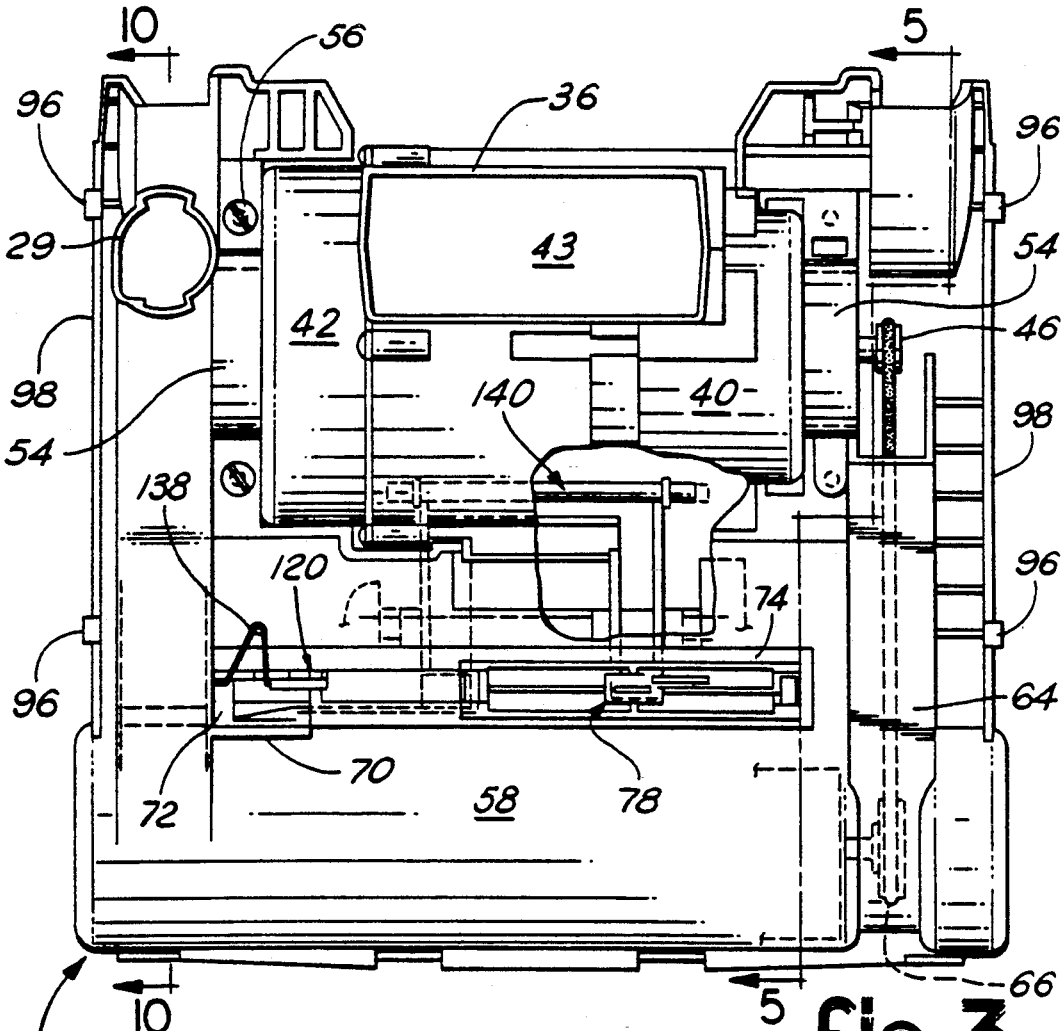
FIG. 3 is a plan view of the cleaner head assembly shown in FIG. 2 and partially in cross-section to reveal certain details of the retainer axle member.
Figure 4:
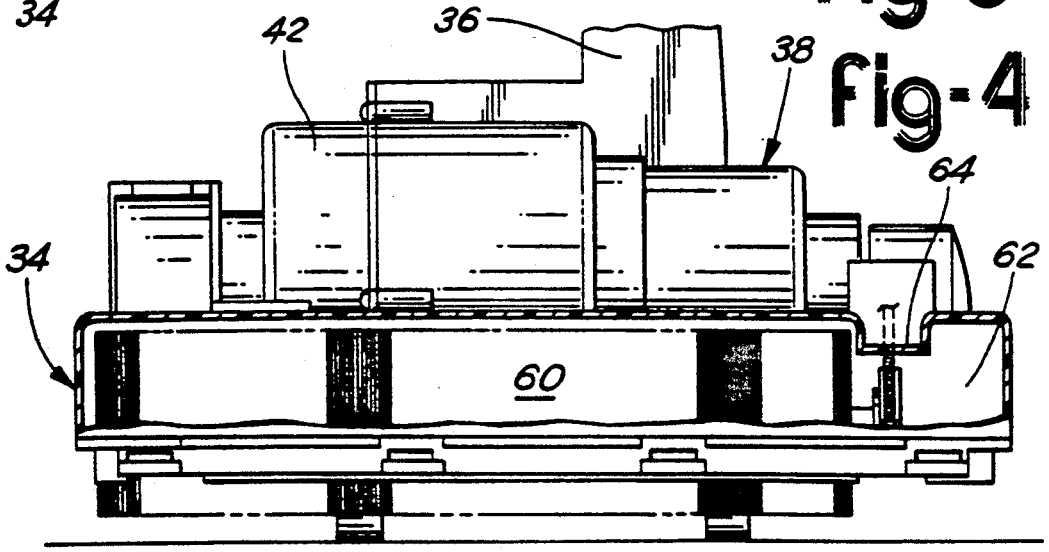
FIG. 4 is a front view of the cleaner head assembly shown in FIG. 2.

As shown basically in FIGS. 3–4, the cleaner head assembly 10 is seen to include an injection molded plastic chassis 34. The operator handle is secured to a bracket portion 36 which carries the suction generating means of the vacuum cleaner, namely a motor/fan assembly generally designated 38, and including a motor 40 at one end and a fan (not shown) at the opposite end and enclosed within a fan housing 42. Bracket 36 forms an air discharge duct 43 leading to the bag assembly 24. Journals 44 are provided at both ends of the motor/fan assembly 38 and the motor 40 includes an agitator driver pulley 46 at its one end. The bracket 36 also provides a stop member 48 which will abut the chassis when the handle 22 is lowered all the way and a chassis lifting cam actuator 50. The motor/fan assembly 38 is pivotally journalled on the chassis at journals 44 shown as half bearing shells. A complementary bearing cap 54 (shown in FIGS. 3 and 4 only) completes the journal at each end and is secured to the lower journal members at mounting holes 56.

The chassis includes a semi-cylindrical, transversely arranged chamber or nozzle housing 58 which is adapted to receive the agitator or roller brush (as shown in phantom line in FIGS. 3 and 4) for rotation about an axis extending transversely of the cleaner head assembly. The chamber is seen to include, from FIGS. 3 and 4, a main chamber 60 and a secondary chamber 62 located at one end thereof for allowing the agitator to extend from one side of the vacuum cleaner assembly to the other and nearly flush with the end panels of the cleaner hood. Positioned between the main and secondary chambers 60,62 at one end is a pulley housing 64 for receiving the drive belt from the motor 40 to the driven pulley of the agitator shown in phantom line as 66. At the opposite end of the main chamber 60 is an air passageway 68 extending along the side of the chassis from the front end to the rear end where it communicates with the inlet of the suction fan.

At the inboard wall of the air passageway 68 there is located within a boss member 70 a doorway 72 adapted to receive a sliding door, described below. Also extending transversely of the chassis there is located a partition member 74 having a transversely extending slot 76 extending through the wall of the chassis and adapted to receive a slidable chassis height adjusting member, generally designated 78. The height adjusting member 78 is of two-piece construction including an upper piece 80 and a lower piece 82 which are adapted to be snap-clipped together with the partition member 74 located therebetween, as shown in FIGS. 7 and 8.

Figure 7:
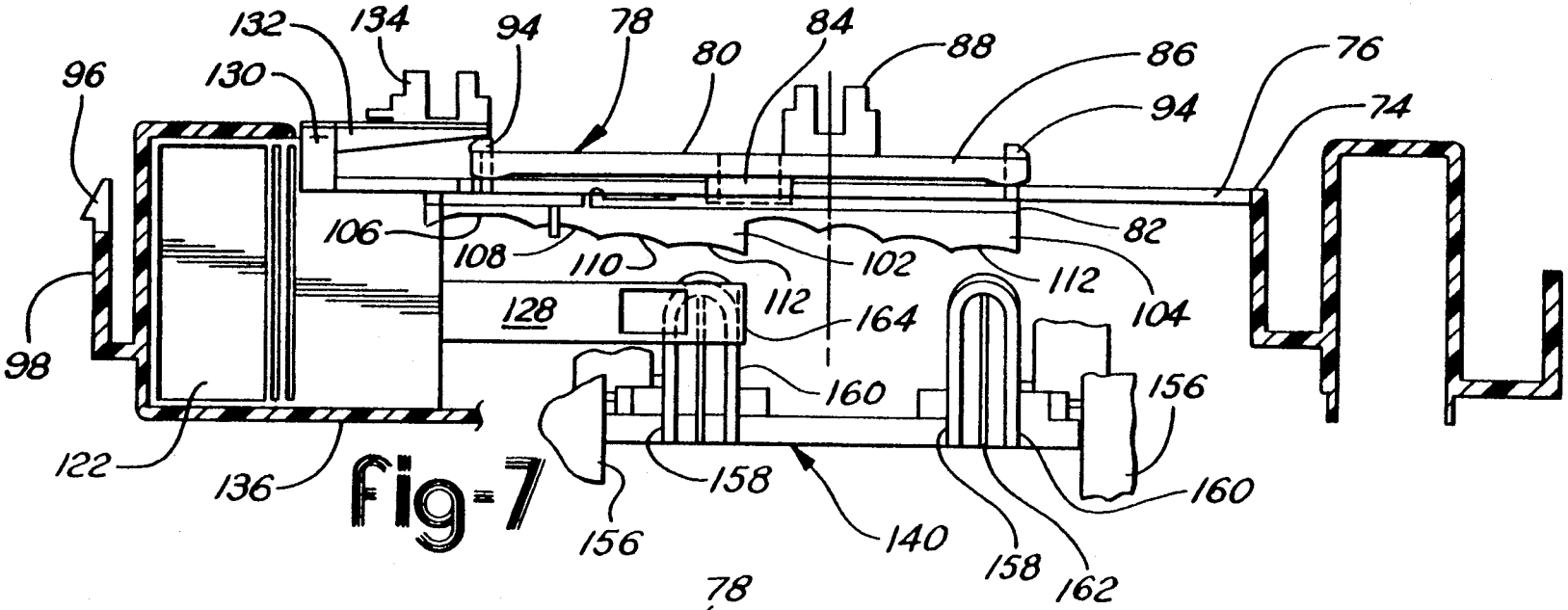
FIG. 7 is a cross-sectional view taken generally along section line 7—7 of FIG. 3 and showing the sliding door panel in the closed position for operating the vacuum cleaner in the off-the-floor suction operation.
Figure 8:
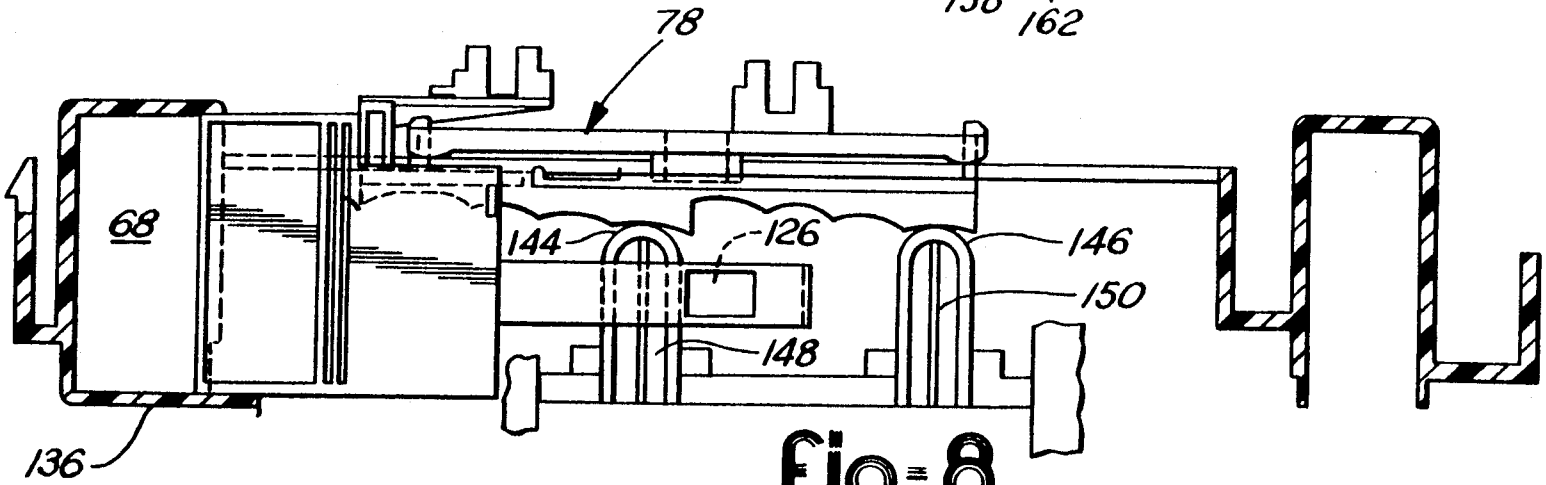
FIG. 8 is a view similar to FIG. 7 but showing the slide door in the open position for operating the vacuum cleaner in the on-the-floor suction mode through the agitator in accordance with the present invention.

As seen in FIG. 2, and particularly FIGS. 7 and 8, the upper height adjusting piece 80 is an elongate member having a sliding guide member 84 slidably received within a slot 86. The piece 80 further includes lug member 88 for receiving an adjusting knob 14 as shown in FIG. 1. At each end of the upper piece, there is provided retainer clip openings 90. The lower height adjusting piece 82 is likewise an elongate member and includes at its ends resilient retaining clips 92, each having a cammed clip lip 94, such that when the two pieces are forced together the resilient clip 92 will fit into the openings 90 and snap laterally outward to engage the top outermost surfaces of the upper piece 80. Similar retainer clips 96 mounted on resilient respective side rails 98 serve to secure the hood 12 to the chassis. The lower piece 82 includes a fixed upwardly projecting locating guide member 100 adapted to be received within the sliding guide portion 84 of the upper piece. Also carried on the lower piece 82, as seen specifically in FIGS. 7 and 8, are a pair of laterally spaced cam surfaces, generally designated 102 and 104. Each of the cam surfaces includes identically stepped cams 106, 108, 110 and 112 defining pairs of matched height adjusting concave cam lobes.

Again referring to FIG. 2, the chassis 34 is designed to receive within the boss 70, and support, a sliding door member 120 which includes a door portion 122 at one end. A cam portion 126 is provided on an arm 128 which is resiliently connected to the door portion 122. Preferably, the chassis 34 and all of the component members including the height adjusting slide member and the slide door (and axle retainer member mentioned below) are of plastic material. Thus, the arm 128 will be inherently resilient. Offset from the plane of the door by a rest 130 is located a slide adjustment arm 132 including a lug portion 134 which is adapted to receive the adjusting knob 16 as shown in FIG. 1.

As shown particularly in FIGS. 3 and 7–9, the slide door member rests on the bottom 136 of the chassis and is adapted to be slid into and out of the air passage 68 through the doorway 72 and supported side-to-side (e.g. fore and aft of the chassis) by the inside walls of the boss member 70. A torsion spring 138 is located between the molding defining the air passageway and the rest 130 of the door member. When the door is manually positioned across the air passageway as shown in FIG. 7, the torsion spring 138 will be fully compressed, and when the door is to be returned to its initial position, whereby the passageway 68 is open to the agitator chamber 60,62 the spring will return the door to the initial position. The sliding door is adapted to be held in the closed position by engagement with the retainer axle member, generally designated 140.

The retainer axle member 140, as seen particularly in FIGS. 2 and 8, includes an integral molded piece including a chassis lifting cam member 142 at its rearward end and a pair of cam followers 144,146 located on respective legs 148,150 and providing a support surface upon which the cam lobes of the respective cam surfaces 102,104 of the height adjusting member may rest. The rate of curvature of each cam follower is greater than that of the stepped cams 106, 108, 110 and 112 thereby assisting in locating the stepped cams and thus the chassis relative to the retainer axle member 140. The retainer axle member includes a pair of axles 152 (only one shown) at its rearward end defining a single pivot axis, and at its forward end it carries a second axle 154 for journalling the forwardmost rollers or casters 156 (shown in FIGS. 5 and 6). Each leg 148,150 is seen to include a pair of spaced walls 158,160 and a reinforcing rib 162 extending parallel but inboard thereof. At the one leg 148, the reinforcing leg is substantially inboard of the outer and forward-most wall so as not to interfere with cam portion 126 providing a stop for the sliding door when it is slid to its closed position, as previously described.

Figure 9:
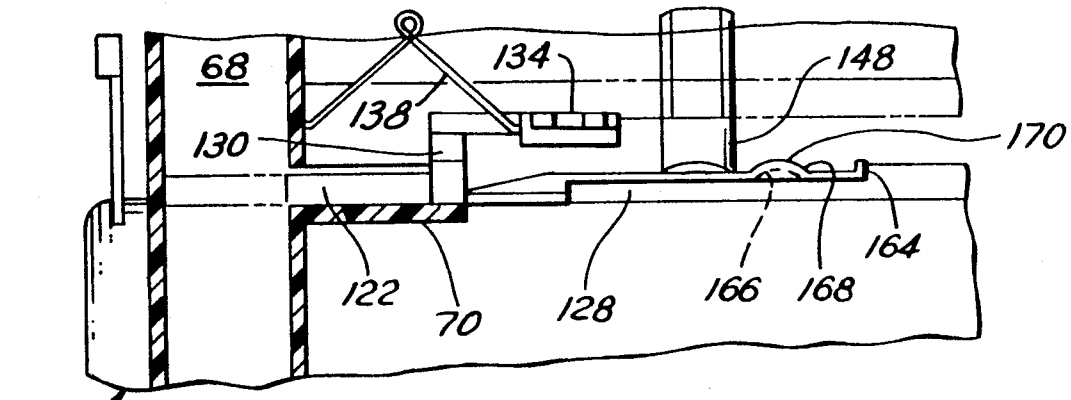
FIG. 9 is a partial detail and cross-sectional plan view of the cleaner head assembly showing the slide door in its fully retracted position whereby the air passageway connecting the agitator is open to the filter bag assembly.
Figure 10:
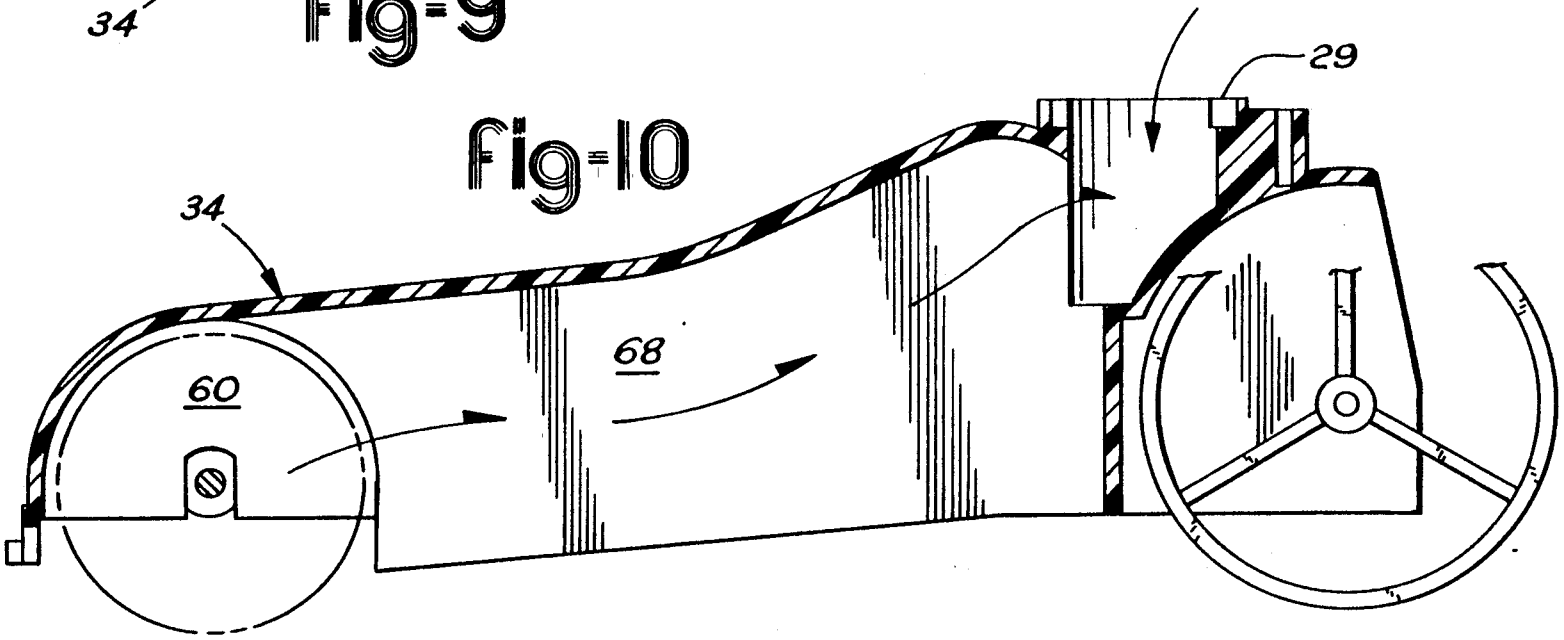
FIG. 10 is an elevation cross-section view taken along lines 10—10 of FIG. 3 and showing the interior of the passageway from the agitator to the suction generator fan/motor assembly inlet.

Referring to the slide door 120, and looking particularly at FIGS. 7–9, it is seen that the cam portion 126 includes a stop member 164 extending toward the rear of the chassis. The cam portion also includes a pair of inclined cam surfaces 166,168 joined at a crown 170 and having a base approximately equalling the width of the leg 148 of the retainer axle member. Thus, as seen in FIGS. 7 and 9, when the sliding door is in a closed position, the inclined surface 168 will be bearing against the wall 158 of the leg 148 under compression of the spring 138 and the stop member 164 on the cam portion 126 will be in near abutment with the inner wall 160. Further, as seen in FIGS. 6 and 8, when the door is in the open position, legs 148,150 will have been displaced toward the rear of the chassis as the retainer axle member pivots about the front caster journals thereby releasing the cam portion 126 to slide under the force of return spring 138 to its closed position.

Figure 5:
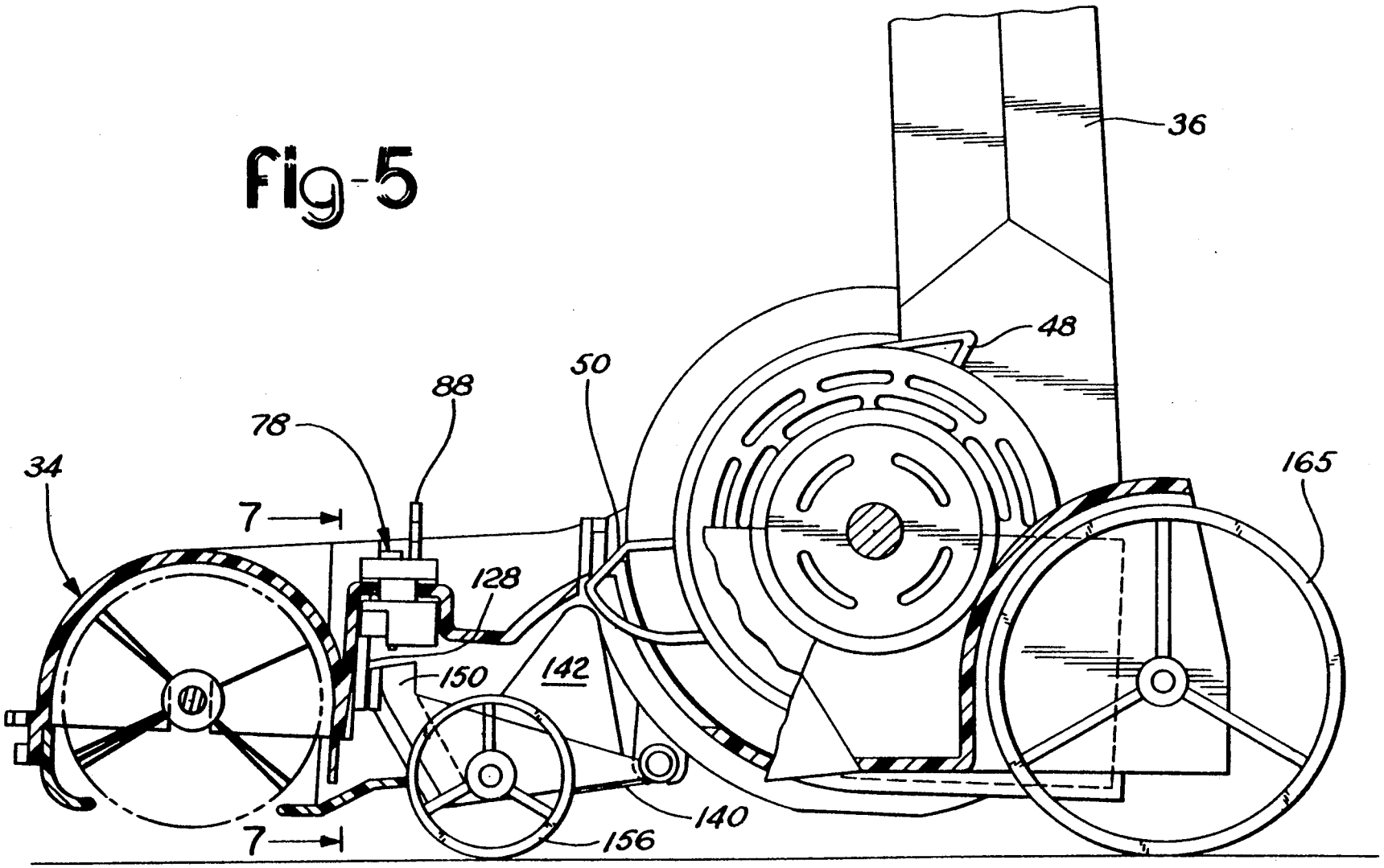
FIG. 5 is an elevational view shown partly in cross-section and showing the cleaner head assembly as supported by the front and rear casters with the agitator lifted off the floor for off-the-floor suction cleaning operation in accordance with the present invention, taken along section line 5—5 of FIG. 3.
Figure 6:
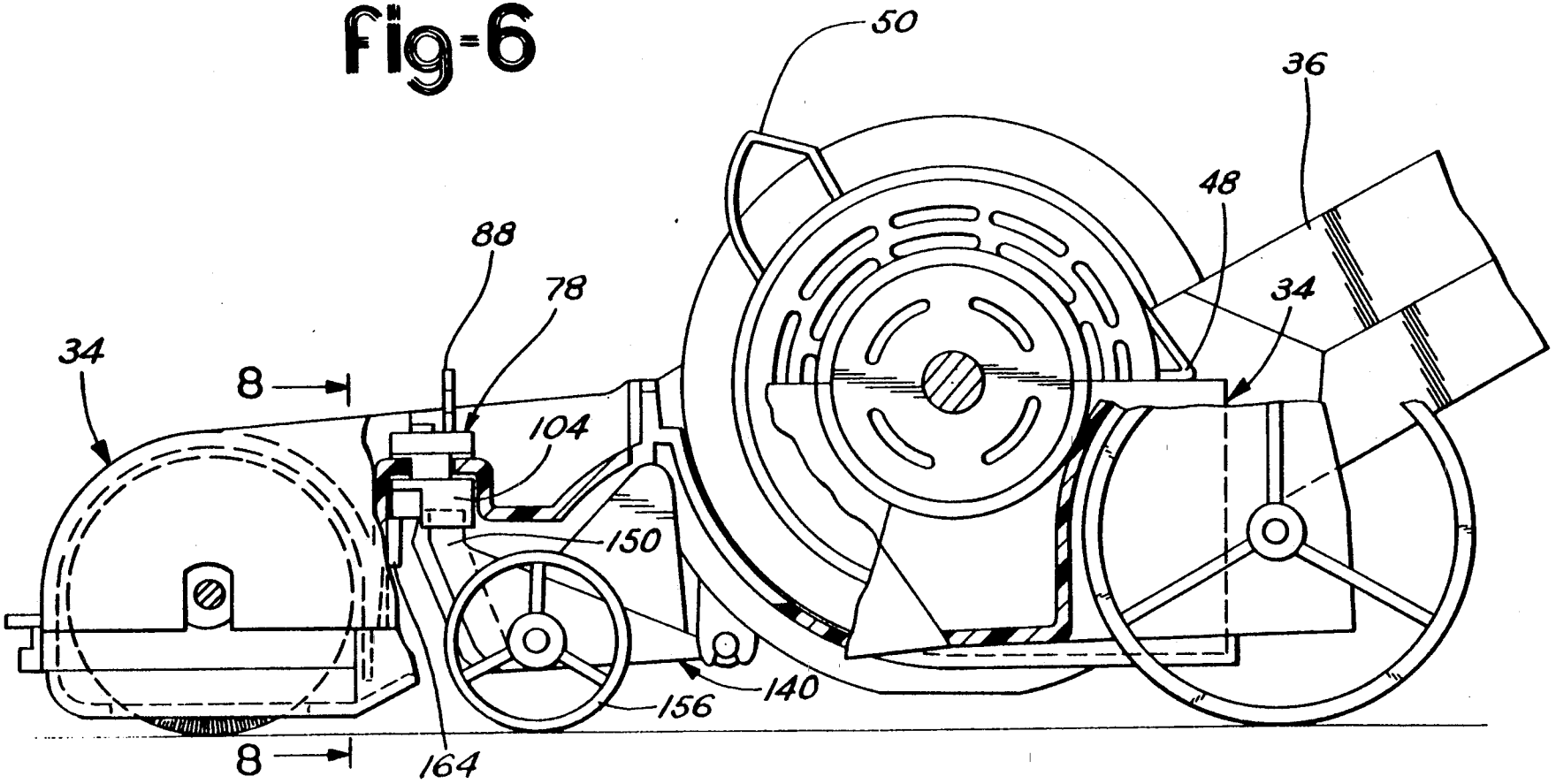
FIG. 6 is a view similar to FIG. 5 but showing the cleaner head assembly and operator handle lowered for on-the-floor suction cleaning operation.

In operation, for on-the-floor vacuum cleaning as seen in FIG. 6, the operating handle 22 will be in a lowered position (i.e., a position other than the vertically upright position as shown in FIG. 5) and the agitator will be in contact with the floor or carpet at a height as set by the height adjusting member 78. This height can be adjusted in a manner as shown in FIG. 8, by sliding the adjusting knob 14 and thus the height adjustment member 78 to any one of the four height positions represented by the pairs of cam lobes 106, 108, 110 and 112. At either one of these positions, the respective pairs of cam lobes, i.e. cam lobes 112 as shown in FIG. 8, will be in engagement with the cam followers 144,146 of the retainer axle member. The chassis will be supported at both support surfaces as defined by the cam followers, thus providing lateral stability to the chassis member as a whole. Otherwise, the vacuum cleaner as shown operates in a conventional manner.

When it is desired to operate the vacuum cleaner in an off-the-floor suction manner utilizing the suction attachment hose feature for cleaning furniture, window blinds, or the like, the operator will return the operating handle 22 to its upright position as shown in FIG. 5. This causes the cam actuator 50 to engage the actuator lifting cam member 142 of the retainer axle member and thereby causes the entire chassis to be lifted about the axis of the rear casters 165 to a position above the floor or carpet as shown. In doing so, it will be noted that the entire retainer axle member is pivoted about the axis of the forward casters 156 and the pivot axis between it and the chassis 34 to a position whereby the leg 148 is engaging and resiliently biasing the cam portion 126 of the sliding door member 120. Next, the operator manually slides the adjusting knob 16 and thus the sliding door 120, to its closed position as shown in FIG. 7. As the cam portion of the sliding door slides over the leg 148 of the retainer axle member, it will first be cammed out of the plane of the leg member and then allowed to snap back into engagement whereby the cam surface 168 abuts the outboard side wall 158 of leg 148 thereby holding the door in the closed position against the bias of the spring 138. With the main chamber 160 thus closed off from the suction generator 38, all of the suction force is directed through the suction attachment hose 26. Thus, as the operator lifts the nozzle 30 from the receiver member 32, full suction force will be received at the nozzle inlet for suction cleaning. When the off-the-floor cleaning operation is concluded, the operator will insert the suction hose and nozzle back into the receiving member 32. Upon resuming on-the-floor cleaning, the operator will lower the operating handle 22 from the upright position to a lowered position as shown in FIG. 6, whereby the retainer axle member will be released from the cam actuator 50 and the cam portion 126 on the sliding door 120 will be pushed by spring 138 from the outboard side of leg 148 to the inboard side thereof, whereby the door will be returned to its initial open position as shown in FIG. 8. Thus, the operator can resume on-the-floor cleaning, without having to manually return the door to its initial on-the-floor cleaning position. Furthermore, the operator will not have disturbed the height adjustment of the chassis and cleaning head assembly relative to the floor or carpet being cleaned.

While the best mode for carrying out the invention has been described in detail, those familiar with the art to which this invention relates will recognize various alternative designs and embodiments for practicing the invention as defined by the following claims.

What is claimed is:

1. An upright vacuum cleaner adapted for on-the-floor and off-the-floor suction cleaning comprising a suction-generating means, a dirt collecting member, and a cleaner head assembly, said cleaner head assembly including a chassis, said chassis including a chamber for a rotary agitator and an air passageway for transferring dirt-ladened air from the chamber to the dirt collecting member, said suction-generating means being intermediate said air passageway and said dirt collecting member and operable to draw a vacuum within said air passageway;

said cleaner head assembly further including coupling means in open communication with said air passageway for coupling a suction attachment hose to said chassis, said coupling means including an attachment hose port located within said chassis and in open communication with said air passageway at a point between the chamber and said suction-generating means;

an operating handle for maneuvering the cleaner and carrying the suction generating means, said operating handle being pivotally connected to the chassis, the operating handle being adapted to be secured in a vertically upright position when the cleaner is to be used for off-the-floor operation;

means for converting the vacuum cleaner to off-the-floor operation comprising door means for closing off said passageway intermediate said chamber and said attachment hose port during off-the-floor operation whereby only said attachment hose port will remain in open communication with the vacuum being drawn within said passageway; and means carried by said operating handle for causing said door means to automatically move to a position opening said passageway intermediate said chamber and said attachment hose port when said operating handle position is altered to allow on-the-floor operation.

2. The invention as in claim 1 further including said chassis being supported for rolling contact with the floor by one roller means at an end of the chassis opposite said chamber and a second roller means intermediate said suction-generating means and said chamber;

said second roller means being journalled to a retainer axle member pivotally connected to said chassis at a first pivot point and including a chassis lifting cam member for rotating said retainer axle member about the axis of said second roller means from a lowered position to a lift position thereby pivoting said chassis about said one roller means and consequently raising said chassis;

cam actuating means carried on said handle for engaging said chassis lifting cam member when the handle is placed in an upright position and thereby causing said chassis to be lifted about said one roller means to raise the chassis off the floor, and to return the chassis to contact with the floor when the handle is lowered from the upright position.

3. The invention as in claim 2 wherein said retainer axle member includes means for retaining said door means in a position closing off said passageway when in the lift position and releasing said door means when adjusted to said lowered position.

4. The invention as in claim 2 wherein said cleaner head assembly includes a hood supported on said chassis; said retainer axle member includes a chassis height adjusting support surface;

cleaner head assembly including a chassis height adjustment member carried by said hood and supported thereby for manual operator assisted sliding engagement with said hood and said retainer axle member;

said height adjustment member including a pair of laterally spaced cam surfaces, and each cam surface including identical stepped cams of varying height thereby defining a plurality of pairs of matched height adjusting cam lobes laterally offset from one another and each engaging said support surface whereby said chassis is supported laterally at two positions on said support surface.

5. The invention as in claim 4 wherein said support surface on the retainer axle member includes a pair of laterally spaced cam followers;

each cam follower being juxtaposed directly under and engaging a respective one of said cam surfaces.

6. The invention as in claim 5 wherein each of said stepped cams presents a concave surface to a respective one of said cam followers on the retainer axle member; and each said cam follower including a rounded end portion of slightly greater rate of curvature than each said stepped cam thereby supporting and laterally securing the position of said chassis relative to said retainer axle member.

7. The invention as in claim 2 wherein said cleaner head assembly includes a hood supported on said chassis;

said retainer axle member including a chassis height adjusting support surface;

said cleaner head assembly including a chassis height adjustment member carried by said hood and supported thereby for manual operator assisted sliding engagement with said hood and said retainer axle member; and whereby the lifting of the chassis for off-the-floor operation is entirely independent of the manual setting of the chassis height adjustment member thereby allowing the chassis height setting to remain undisturbed by any alternate use of the cleaner for off-the-floor operation.

8. The invention as in claim 7 wherein said retainer axle member includes means for retaining said door means in a position closing off said passageway when in the lift position and releasing said door means when adjusted to said lowered position.

9. The invention as in claim 8 wherein said door means comprises a thin door plate member of inherently resilient material and having a door panel at one end and a cam portion at the opposite end;

said cam portion being engaged when in the closed position by said retaining means of the axle retainer member; and a spring means for biasing said plate member relative to said chassis to an open position whereby the door panel clears said passageway and said cam portion clears said retainer axle member.

10. The invention as in claim 9 wherein the cam portion of said door plate member includes a cam having a first inclined surface and a second inclined surface joined at a crown and thereby being of equal lift, and a stop member projecting transversely and laterally displaced therefrom;

one said inclined surface directly abutting said retainer axle member against the bias of said spring means to hold said door means in a closed position, and being disengaged out of abutting engagement therewith as said operating handle is lowered from an upright position and said retainer axle member is thereby caused to rotate relative to said chassis and door means; and said cam portion being resiliently biased against said retainer axle member due to the inherent resiliency of said door plate member and said abutment member being thereby caused to be in overlapping relation to said retainer axle member in the lateral direction of travel of said door plate member.

11. The invention as in claim 1 wherein said door means includes a manually adjustable positioning member at the exterior of said cleaner head assembly for allowing the operator to position the door means to a closed position and thereby within the passageway for off-the-floor operation;

said door means being self-locking in said closed position.

12. An upright vacuum cleaner adapted for on-the-floor and off-the floor suction cleaning comprising a suction-generating means, a dirt collecting member, and a cleaner head assembly, said cleaner head assembly including a chassis, said chassis including a chamber for a rotary agitator and an air passageway for transferring dirt-ladened air from the chamber to the dirt collecting member, said suction-generating means being intermediate said air passageway and said dirt collecting member and operable to draw a vacuum within said air passageway;

said cleaner head assembly further including coupling means in open communication with said air passageway for coupling a suction attachment hose to said chassis, said coupling means including an attachment hose port located within said chassis and in open communication with said air passageway at a point between the chamber and said suction-generating means;

an operating handle for maneuvering the cleaner, said operating handle being pivotally connected to the chassis, the operating handle being adapted to be secured in a vertically upright position when the cleaner is to be used for off-the-floor operation;

means for converting the vacuum cleaner to off-the-floor operation comprising door means for closing off said passageway intermediate said chamber and said attachment hose port during off-the-floor operation whereby only said attachment hose port will remain in open communication with the vacuum being drawing within said passageway;

means carried by said operating handle for causing said door means to automatically move to a position opening said passageway intermediate said chamber and said attachment hose port when said operating handle position is altered to allow on-the-floor operation;

said chassis being supported for rolling contact with the floor by one roller means at an end of the chassis opposite said chamber and a second roller means intermediate said suction-generating means and said chamber;

said second roller means being journalled to a retainer axle member pivotally connected to said chassis at a first pivot point and including a chassis lifting cam member for rotating said retainer axle member about the axis of said second roller means from a lowered position to a lift position thereby pivoting said chassis about said one roller means and consequently raising said chassis;

cam actuating means carried on said handle for engaging said chassis lifting cam member when the handle is placed in an upright position and thereby causing said chassis to be lifted about said one roller means to raise the chassis off the floor, and to return the chassis to contact with the floor when the handle is lowered from the upright position; and said retainer axle member including means for retaining said door means in a position closing off said passageway when in the lift position and releasing said door means when adjusted to said lowered position.

* * * * *